US005516300A

United States Patent [19]

Tsuji

[11] Patent Number: 5,516,300

[45] Date of Patent: May 14, 1996

[54] CONNECTOR HAVING SELECTIVELY DISABLED SHORT CIRCUIT TERMINAL

[75] Inventor: Takeshi Tsuji, Yokkaichi, Japan

[73] Assignee: Sumitomo Wiring Systems, Ltd., Mie, Japan

[21] Appl. No.: 240,482

[22] Filed: May 10, 1994

[30] Foreign Application Priority Data

May 12, 1993 [JP] Japan ..... 5-135366

[51] Int. Cl.[6] ..... H01R 13/703

[52] U.S. Cl. ..... 439/188; 200/51 R; 439/372

[58] Field of Search ..... 439/188, 488, 439/489, 372; 200/51.1, 51.09, 51 R

[56] References Cited

U.S. PATENT DOCUMENTS

| | | | |
|---|---|---|---|
| 4,904,196 | 2/1990 | Sueyoshi et al. | 439/188 |
| 5,035,644 | 7/1991 | Nakazato et al. | 439/490 |
| 5,131,865 | 7/1992 | Taguchi et al. | 439/489 |

*Primary Examiner*—Neil Abrams

*Attorney, Agent, or Firm*—Oliff & Berridge

[57] ABSTRACT

Terminal receiving chambers are formed within an air bag-side housing and are disposed respectively at right and left portions of the housing. A female metal terminal is fitted in each of these chambers. A short-circuit member receiving chamber is formed between the two terminal receiving chambers, and a short-circuit member is fitted in the chamber. Contact portions that project from respective right and left side portions of the short-circuit member extend through respective insertion grooves formed through respective opposite side walls of the receiving chamber and are resiliently contacted with respective inner surfaces of the female metal terminals. An insulating member projects from a reverse surface of a manipulation lever, which is pivotally mounted by pins on a mating power source-side housing and is adapted to intrude between one of the side portions of the short-circuit member and the corresponding female metal terminal through an open groove formed in an upper portion of the air bag-side housing. With such a construction, it is possible to provide a short circuit member that is reduced in height and space.

19 Claims, 3 Drawing Sheets

CONNECTOR HAVING SELECTIVELY DISABLED SHORT CIRCUIT TERMINAL

BACKGROUND OF THE INVENTION

This invention relates to a connector provided with a short-circuit member for short-circuiting open metal terminals and an insulating member for disabling the short-circuit member.

Air bags have been increasingly used for protecting a passenger against an impact in the event of a car crash or accident. An operating circuit for such an air bag is formed by connecting metal terminals connected to an igniter for a gas-generating agent to metal terminals connected to a power source via an impact sensor. When the car collides, the impact sensor sends current to the igniter to ignite the gas-generating agent to produce a large amount of gas, thereby inflating the air bag.

Although the air bag is required to be positively operated in the event of a collision, the air bag must be operated only when a collision occurs. For example, the connection between the connectors can be released during the inspection or installation of the air bag at which time the metal terminals within the air bag-side connector housing become open. Even in this condition, however, there is a chance that a magnetic field or an electric field produced around these open metal terminals induces a voltage to develop between the open metal terminals so that current flows into the igniter of the air bag, thus causing erroneous operation.

In order to solve the problem of erroneous inflation of the air bag, one connector has been proposed in Japanese Utility Model Unexamined Publication No. 1-77287. More specifically, a pair of metal terminals connected to an igniter and a short-circuit member of an electrically-conductive material that resiliently contacts upper surfaces of the pair of metal terminals are provided within an air bag-side connector housing, whereas metal terminals connected to a power source and an insulating member adapted to intrude between the short-circuit member and the upper surfaces of the metal terminals (with which the short-circuit member is resiliently contacted) when the two connector housings are fitted together are provided within a power source-side connector housing. When the two housings are not fitted together, the short-circuit member resiliently contacts the metal terminals within the air bag-side housing to prevent a potential difference from developing between the metal terminals, thereby preventing current from accidentally flowing into the igniter, thus preventing an erroneous operation. When the housings are fitted together, the insulating member or plate intrudes between the short-circuit member and the pair of metal terminals to interrupt an electrical connection between the pair of metal terminals, and by doing so, a short-circuit accident is prevented from occurring when current flows into the igniter side.

However, the conventional connector is of such a construction that the short-circuit member is disposed above the upper surfaces of the pair of metal terminals and is resiliently contacted therewith, therefore increasing the vertical dimension of the housing. As a result, the use of such a connector has often been limited. Such a disadvantage may arise not only in the connector for an air bag, but also in those connectors with a short-circuit member for other applications.

SUMMARY OF THE INVENTION

It is an object of this invention to provide a connector in which the vertical dimension of a housing receiving a short-circuit member is reduced.

This and other objects of the present invention have been achieved by providing a connector wherein terminal receiving chambers for respectively receiving metal terminals are formed within one of female and male connector housings to be fitted together, and are disposed respectively at right and left side portions of the one housing; a short-circuit member receiving chamber is formed between the two terminal receiving chambers; a short-circuit member of an electrically-conductive material received in the short-circuit member receiving chamber has contact portions formed respectively at right and left sides thereof, the contact portions being resiliently contacted with the two metal terminals, respectively; and an insulating member is provided inside of the other connector housing, and intrudes between at least one of the contact portions of the short-circuit member and the corresponding metal terminal in a fitted condition of the connector.

Another aspect of the present invention is provided by a connector having a first housing for receiving a pair of terminals in a pair of terminal receiving chambers, a short circuit member, and a short circuit member housing located between the terminal receiving chambers; and a second housing adapted to slidingly receive the first housing, the second housing having a reciprocal manipulation lever for selectively disabling the short circuit member when the first and second housings are in a fitted condition.

Another aspect of the present invention is provided by a connector having a first housing including terminals and a short circuit terminal located between the terminals, the short circuit terminal including contact portions for resiliently contacting each of the terminals, side portions coupled to each of the contact portions, and a slanted portion connected to at least one of the side portions.

Another aspect of the present invention is provided by a connector having a first housing and a second housing engagable with the first housing in a fitted condition, and means for selectively disabling a short circuit terminal located on one of the first and second housings when in the fitted condition.

When the two connector housings are not fitted together, the contact portions of the short-circuit member provided between the right and left metal terminals, provided in one housing in which opening and closing of the short-circuiting device occurs, are resiliently contacted respectively with the two metal terminals, thus short-circuiting the two metal terminals.

When the two housings are fitted together, the insulating member provided inside of the other housing intrudes between at least one of the contact portions of the short-circuit member and the corresponding metal terminal, thereby interrupting an electrical connection between the metal terminals.

The short-circuit member is provided between the right and left metal terminals, and with this construction the connector housing receiving these terminals can be reduced in vertical dimension.

BRIEF DESCRIPTION OF THE DRAWINGS

The invention will be described in detail with reference to the following drawings wherein:

FIG. 3(A) shows a condition immediately before a manipulation lever is locked, and FIG. 3(B) shows a locked condition; FIG. 4(A) shows a condition immediately before the manipulation lever is locked, and FIG. 4(B) shows the locked condition.

DETAILED DESCRIPTION OF PREFERRED EMBODIMENTS

Figure 1:
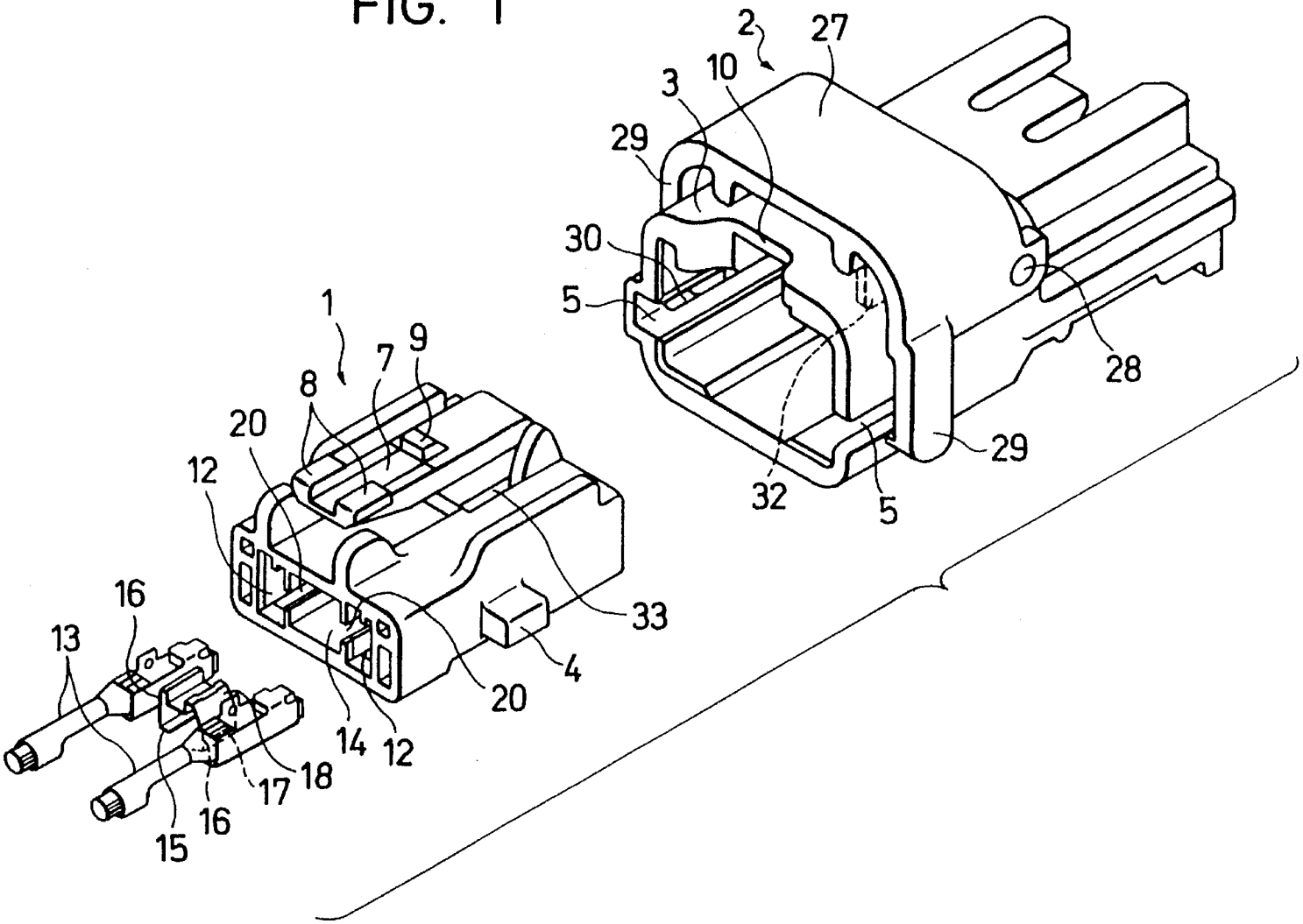
FIG. 1 is an exploded, perspective view of one preferred embodiment of the present invention.

One preferred embodiment of the present invention will now be described in detail with reference to the drawings. In FIG. 1, reference numeral 1 denotes an air bag-side connector housing and reference numeral 2 denotes a power source-side connector housing. The air bag-side housing 1 can be fitted into a larger-width portion 3 provided at a front side of the power source-side housing 2 in such a manner that fitting projections 4 formed respectively at right and left sides of the housing 1 slide respectively along guide grooves 5. In addition, a retaining piece 7 that extends rearwardly in a generally folded manner from a front edge of the air bag-side housing 1 at an upper surface thereof is elastically urged downwardly.

Figure 3A:
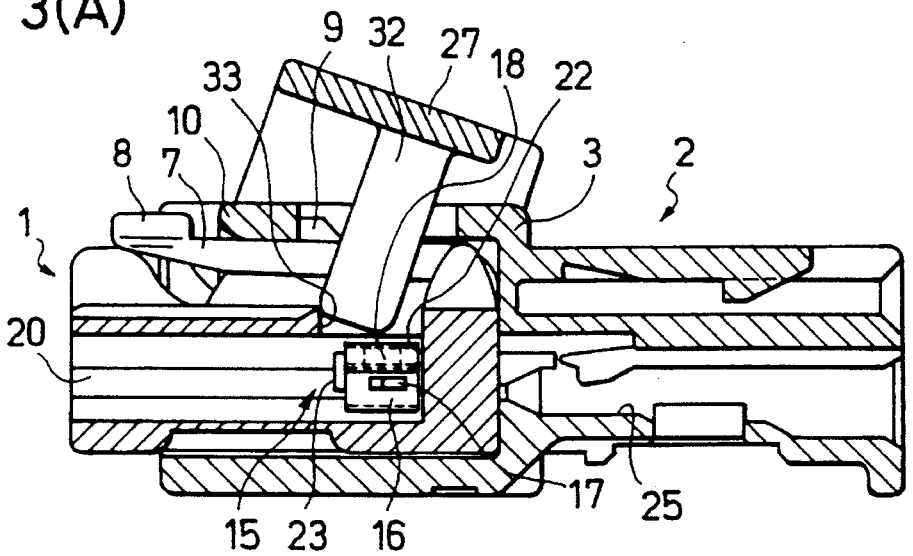
FIGS. 3(A) and 3(B) are vertical cross-sectional views showing a short-circuiting releasing operation.
Figure 3B:
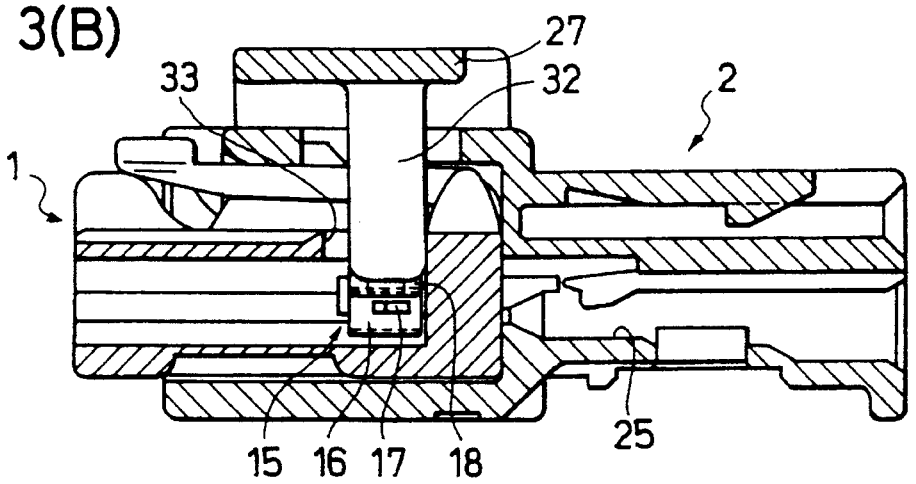

The retaining piece 7 is elastically restored when the two connector housings 1 and 2 are fitted together, as shown in FIGS. 3A and 3B, so that a clamp portion 10 formed at a front edge portion of the power source-side housing 2 at the upper side thereof is held between opposed clamp portions 8 and 9, thereby holding the two connector housings 1 and 2 in a fitted condition. In addition, the clamp portions 8 and 9 are formed on the retaining piece 7 and spaced a predetermined distance from each other.

On the other hand, by removing the clamp portion 10 from between the clamp portions 8 and 9 by pressing down the end portion of the retaining piece 7, the two connector housings 1 and 2 can be disengaged from each other.

Terminal receiving chambers 12 are formed respectively at right and left side portions of the air bag-side housing 1, and a pair of female metal terminals 13, connected to respective ends of signal wires connected to an igniter for igniting a gas-generating agent of an air bag are fitted respectively into the terminal receiving chambers 12 from the rear side.

Figure 4A:
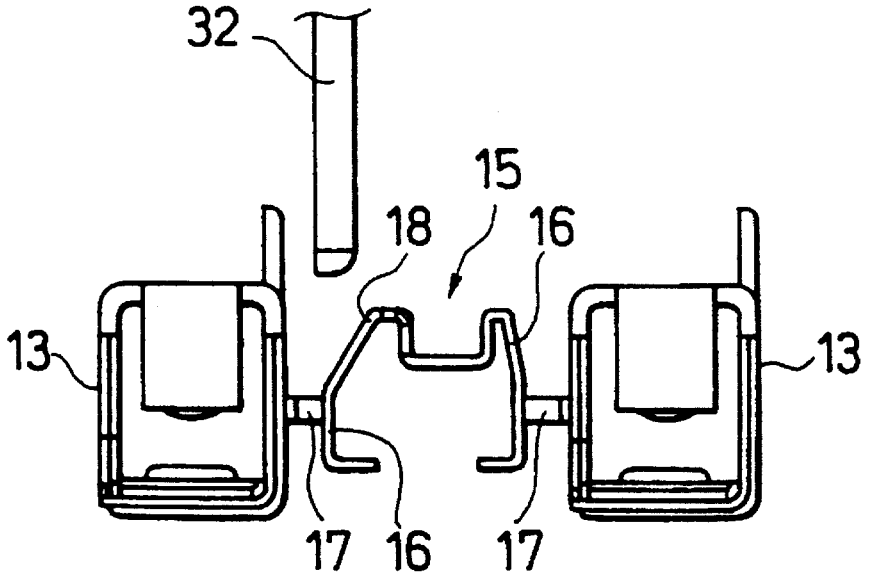
FIGS. 4(A) and 4(B) are schematic, horizontal cross-sectional views showing the short-circuiting releasing operation.
Figure 4B:
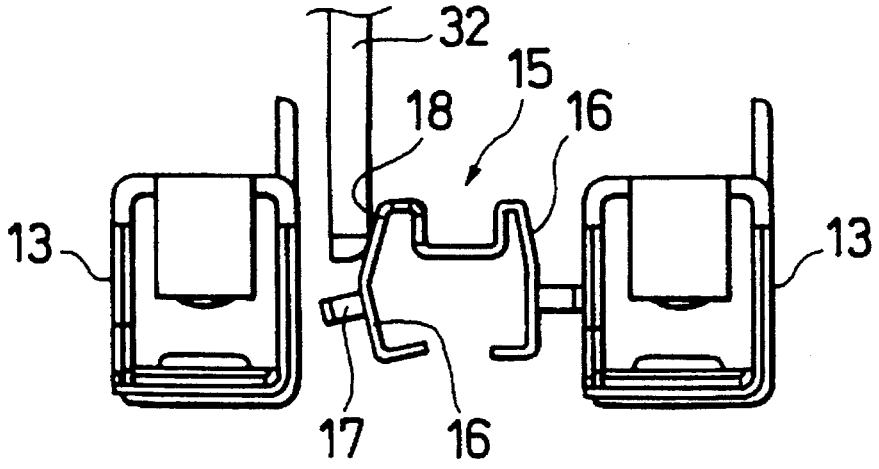

A short-circuit member receiving chamber 14 for receiving a short-circuit member 15 is formed between the right and left terminal receiving chambers 12. The short-circuit member 15 is made by forming a resilient, electrically-conductive plate into a generally M-shaped cross-section as shown in FIGS. 4A and 4B. A contact portion 17 extends outwardly from an outer surface of each of right and left side portions 16 of the short-circuit member, and a slanted surface 18 is formed on an upper portion of one of the side portions 16. Longitudinally extending insertion grooves 20 for respectively passing the right and left contact portions 17 of the short-circuit member 15 therethrough are formed respectively through the right and left walls of the short-circuit member receiving chamber 14.

The short-circuit member 15 is pushed into the short-circuit member receiving chamber 14 from the rear side with the right and left contact portions 17 received in respective insertion grooves 20 and is held between an abutment surface 22 formed at the inner end of the receiving chamber 14 and a resilient retaining pawl 23 extending rearwardly from the abutment surface 22, so that the short-circuit member 15 is fixed in a predetermined position and the right and left contact portions 17 of the short-circuit member 15 extend through respective insertion grooves 20 and are pressed respectively against the inner surfaces of the female metal terminals 13 by their own resiliency.

Similarly, right and left terminal receiving chambers 25 are formed within the power source-side housing 2. A pair of male metal terminals (not shown) that serve as terminals for signal wires connected via an impact sensor to a power source within a car are provided at respective chambers 25 and can be intimately fitted in the respective female metal terminals 13.

A manipulation lever 27 for short-circuiting the female metal terminals 13 and for disabling short-circuiting is pivotally mounted by pins 28 on the power source-side housing 2 in straddling relation to the upper surface of the larger-width portion 3.

Retaining pawls 29 extend respectively from lower edges of right and left sides of the manipulation lever 27. The retaining pawl 29 can be engaged in a retaining hole 30 formed in the bottom of one of the guide grooves 5 of the larger-width portion 3 and the other retaining pawl 29 can be engaged with the fitting projection 4 of the air bag-side housing 1 that projects from the other guide groove 5 in the fitted condition, so that the manipulation lever 27 is releasably locked in a predetermined posture in such a manner that the surface of this manipulation lever is disposed parallel to the upper surface of the larger-width portion 3.

An insulating member 32 is formed on and depends from the reverse surface of the manipulation lever 27 and is provided at such a position that it can be brought into registry with the side portion 16 of the short-circuit member 15 having the slanting surface 18. An open groove 33 for allowing the swinging insulating member 32 to move into and out of the air bag-side housing 1 is formed through the upper wall of the housing 1.

Figure 2:
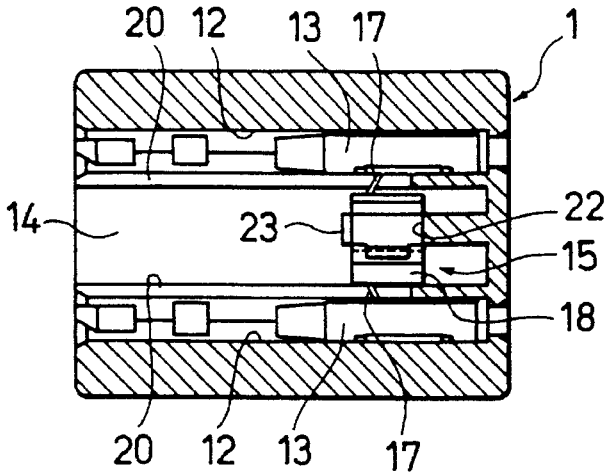
FIG. 2 is a horizontal cross-sectional view of an air bag-side housing.

The operation and effects of the embodiment of the above construction will now be described. When the two connector housings 1 and 2 are not fitted together during the installation of the air bag or during inspection, the two contact portions 17 of the short-circuit member 15 are resiliently contacted respectively with the right and left female metal terminals 13 within the air bag-side housing, as shown in FIG. 2. This prevents a potential difference from developing between the two female metal terminals 13, and therefore prevents current from accidentally flowing into the igniter and erroneous operation of the air bag from occurring.

Before the two housings 1 and 2 are fitted together, the manipulation lever 27 mounted on the power source-side housing 2 is turned rearwardly into an upstanding position so as not to interfere with the insertion of the air bag-side housing 1.

When the two housings 1 and 2 are fitted together as described above, the female and male metal terminals received respectively in the two housings are connected. When the manipulation lever 27 is pivotally moved forwardly, the distal end portion of the insulating member 32 is inserted into the open groove 33 in the air bag-side housing 1, as shown in FIGS. 3(A) and 4(A). Then, when the manipulation lever 27 is further moved downward to be locked in the retained position, the distal end of the insulating member 32 is pressed against the slanting surface 18 of the corresponding side portion 16 of the short-circuit member 15 and intrudes to bend the side portion 16 inwardly against the resiliency thereof, so that the contact portion 17 of the side portion 16 previously in resilient contact with the female metal terminal 13 is disengaged from the female metal terminal. As a result, the electrical connection between the pair of female metal terminals 13 is interrupted, thereby deactivating the short circuit terminal and allowing current to be supplied from the power source to the igniter in the event of a car crash or collision.

Thus, in this embodiment, the short-circuit member 15 is provided between the right and left female metal terminals 13 within the air bag-side connector housing 1. With this construction, the housing 1 can be formed into a rather flat configuration having a reduced vertical dimension.

In the above embodiment, although the insulating member 32 is adapted to intrude on the one side of the short-circuit member 15, there may be provided such a construction that such insulating members intrude on the opposite sides of the short-circuit member, respectively.

While the invention has been described in detail with reference to preferred embodiments thereof, which are intended to be illustrative but not limiting, various changes may be made without departing from the spirit and scope of the invention. For example, the present invention is not limited to the connector for an air bag, but can also be applied extensively to a wide range of connectors of the type that include a short-circuit member for short-circuiting open metal terminals when the fitting of connector housings is released so that current will not accidentally flow and an insulating member for disabling the short-circuiting member.

What is claimed is:

1. A connector comprising a first connector housing having a pair of terminal receiving chambers for receiving metal terminals disposed respectively at right and left side portions of said first housing; a short circuit member receiving chamber formed between said pair of terminal receiving chambers; a short circuit member of an electrically-conductive material received in said short circuit member receiving chamber, said short circuit member having contact portions formed respectively at right and left sides thereof, said contact portions being resiliently contacted with said metal terminals; and a second connector housing having an insulating member provided inside the second connector housing, said insulating member protruding through openings in walls of both said first and second housings to break electrical contact between at least one of said contact portions of said short circuit member and a corresponding one of said metal terminals when the first and second housings are in a fitted condition.

2. A connector comprising:

a first housing for receiving a pair of terminals in a pair of terminal receiving chambers, a short circuit member resiliently and electrically engagable with said pair of terminals, and a short circuit member chamber located between said pair of terminal receiving chambers for receiving said short circuit member; and a second housing adapted to slidingly receive said first housing, said second housing having an aperture and a manipulation lever for causing a disabling member to protrude through said aperture into said second housing to selectively disable said short circuit member when said first and second housings are in a fitted condition.

3. The connector of claim 2, wherein said short circuit member includes a pair of contact portions resiliently biased towards respective ones of said pair of terminals, and a pair of side portions coupled to respective ones of said contact portions.

4. The connector of claim 3, wherein one of said pair of side portions further includes a slanted portion.

5. The connector of claim 4, wherein said disabling member is an insulating member attached to said manipulation lever, said insulating member being engagable with said slanted portion to selectively separate at least one of said side portions and its associated contact portion apart from its associated terminal to thereby disable said short circuit member.

6. The connector of claim 4, wherein said contact portions, said side portions and said slanted portion are made from an electrically conductive material.

7. The connector of claim 2, wherein said manipulation lever is pivotably connected to said second housing between a first position for allowing the first and second housings to achieve said fitted position and a second position for disabling said short circuit terminal.

8. The connector of claim 7, wherein said manipulation lever is movable between said first position and said second position when said housings are in said fitted position.

9. The connector of claim 7, wherein said disabling member comprises an insulating member adapted to be received in a first opening formed in said first housing and between one of said contact portions and its associated terminal to selectively disable said short circuit member.

10. The connector of claim 9, wherein said aperture comprises a second opening formed in said second housing, and wherein said first opening and said second opening are registered in said fitted condition.

11. The connector of claim 2, wherein said manipulation lever further comprises a first retaining pawl and a second retaining pawl, said first pawl and said second pawl straddling said second housing.

12. The connector of claim 11, wherein said first retaining pawl is engagable with a retaining hole formed in said second housing, and said second retaining pawl is engagable with a fitting projection formed on said first housing.

13. The connector of claim 2, further comprising a retaining piece attached to said first housing and resiliently engagable with said second housing to selectively maintain said fitted condition.

14. A connector comprising:

A first housing including terminals and a short circuit terminal located between said terminals, said short circuit terminal including contact portions for resiliently contacting each of said terminals, a side portion supporting each of said contact portions, and a slanted portion extending from at least one of said side portions; and a second housing adapted to receive said first housing, said second housing including a reciprocatable manipulation lever that includes a depending insulating plate, said insulating plate being engageable with said slanted portion to disable said short circuit terminal.

15. The connector of claim 14, further comprising a first opening located in said first housing and a second opening located on said second housing, wherein said first and second openings are registered in a fitted condition to allow said insulating plate to pass therebetween.

16. The connector of claim 14, further comprising a first retaining pawl and a second retaining pawl connected to said manipulation lever, wherein said first retaining pawl is engagable with a retaining hole formed in said second housing and said second retaining pawl is engagable with a fitting projection formed on said first housing.

17. The connector of claim 14, wherein said manipulation lever is pivotably attached to said second housing and is movable between an open position allowing the first and second housings to be connected and a closed position to disable said short circuit terminal.

18. A connector comprising:

a first housing and a second housing each having respective openings that align when the first and second housings are placed in a fitted condition;

a short circuit terminal located within one of the first and second housings; and means for selectively disabling the short circuit terminal by inserting at least a portion of said means for selectively disabling within said openings when said first and second housings are in said fitted condition.

19. The connector of claim 18, wherein said short circuit terminal comprises a pair of contact portions engagable with respective ones of a pair of terminals, a side portion coupled to each of said contact portions, and a slanted portion coupled with one of said side portions, wherein said selective disabling means comprises an insulation member selectively engagable with said slanted portion of said short circuit terminal.

* * * * *